US005130035A

United States Patent [19]

Dell'Armo et al.

[11] Patent Number: 5,130,035

[45] Date of Patent: Jul. 14, 1992

[54] LIQUID FABRIC CONDITIONER CONTAINING FABRIC SOFTENER AND RED DYE

[75] Inventors: Lisa A. Dell'Armo, Park Ridge, N.J.; Jeanie Lew, Bayside, N.Y.

[73] Assignee: Lever Brothers Company, Division of Conopco, Inc., New York, N.Y.

[21] Appl. No.: 759,964

[22] Filed: Sep. 16, 1991

Related U.S. Application Data

[63] Continuation of Ser. No. 618,440, Nov. 27, 1990, abandoned.

[51] Int. Cl.[5] ..... D06M 10/08

[52] U.S. Cl. ..... 252/8.6; 252/8.7; 252/8.75; 252/8.8; 252/8.9

[58] Field of Search ..... 252/8.6, 8.7, 8.75, 252/8.8 R, 8.9

[56] References Cited

U.S. PATENT DOCUMENTS

| | | | |
|---|---|---|---|
| 3,892,669 | 7/1975 | Rapisarda et al. | 252/8.8 |
| 4,134,838 | 1/1979 | Hooper et al. | 252/8.8 |
| 4,137,180 | 1/1979 | Naik et al. | 252/8.8 |
| 4,203,851 | 5/1980 | Ramachandran | 252/8.8 |
| 4,255,294 | 3/1981 | Rudy et al. | 252/8.8 |
| 4,272,413 | 6/1981 | Bauman | 252/8.8 |
| 4,283,192 | 8/1981 | Bauman | 252/8.8 |
| 4,348,305 | 9/1982 | Hennemann et al. | 252/8.8 |
| 4,562,097 | 12/1985 | Walter et al. | 252/8.8 |
| 4,654,163 | 3/1987 | Quack et al. | 252/312 |
| 4,822,499 | 4/1989 | Wahl et al. | 252/8.8 |
| 4,844,820 | 7/1989 | Piper et al. | 252/8.8 |
| 4,863,620 | 9/1989 | Coffindaffer | 252/8.8 |
| 4,897,208 | 1/1990 | Wahl et al. | 252/8.8 |
| 4,994,193 | 2/1991 | Wahl | 252/8.8 |

*Primary Examiner*—A. Lionel Clingman
*Assistant Examiner*—William S. Parks
*Attorney, Agent, or Firm*—Rimma Mitelman

[57] ABSTRACT

Liquid fabric conditioning compositions of an aesthetically pleasing, substantially non-fading pink color. The compositions incorporate a cationic fabric softening compound and 1 ppm to 1000 ppm of selected water-soluble red colorants.

10 Claims, No Drawings

LIQUID FABRIC CONDITIONER CONTAINING FABRIC SOFTENER AND RED DYE

This is a continuation application of Ser. No. 618,440, filed Nov. 27, 1990, now abandoned.

FIELD OF THE INVENTION

The present invention relates to liquid fabric conditioning compositions and conditioning of fabrics in an aqueous wash bath.

BACKGROUND OF THE INVENTION

Liquid fabric conditioning compositions are known in the art. Liquid fabric softening compositions containing a light-stable pink color are described by Wahl, U.S. Pat. No. 4,822,499. Softening compositions of a light-stable pink color are described by Wahl, U.S. Pat. No. 4,897,208. Dyes utilized in the '208 patent are oil-soluble and are said to be very difficult to incorporate. Piper et al., U.S. Pat. No. 4,844,820 discloses liquid softening compositions of a light unstable pink color, the compositions requiring protective packaging to protect them from light. Coffindafer, U.S. Pat. No. 4,863,620 discloses a liquid fabric conditioning composition having a pH of less than 6 and containing specific yellow and blue colorants which provide a yellow color in the composition and which upon dilution and increase of pH to about 7.5 turn blue.

Red dyes described herein have not been previously disclosed for use in fabric softening compositions. The '499 patent discloses four light stable dyes that produce pink shades. However, the present invention offers additional dyes that produce aesthetically pleasing pink colors, enabling the practitioner to choose from a greater variety of light-stable dyes for preparation of pink-colored liquid fabric softeners.

It is very difficult to find dyes that on addition to a liquid conditioning product result in an aesthetically pleasing pink-colored product. Many red dyes provide pink shades but are unacceptable to a consumer because of potential toxicity or, if safe, because they produce undesirable shades. Other red dyes provide pink color but are unstable on storage or fade upon exposure to light.

SUMMARY OF THE INVENTION

The present invention concerns the use in liquid fabric conditioning products of specific red dyes. It has been discovered that incorporation of selected red dyes into liquid fabric conditioning compositions having a pH of less than about 7 results in an aesthetically pleasing pink-colored product. The liquid fabric conditioning product of the present invention is substantially non-fading upon exposure to light.

According to the present invention, a liquid fabric conditioning composition is provided having a pH of less than about 7 and containing from about 1% to about 40% of a fabric softening component and about 1 ppm to 1,000 ppm of a colorant system including a colorant selected from the group consisting of C.I. Acid Red #52, C.I. Reactive Red #147, C.I. Reactive Red #56, and mixtures thereof. The fabric softening component employed in the present invention includes a cationic fabric softener.

Liquid conditioning compositions of the present invention include a liquid carrier and may be formulated as diluted or concentrated products.

DETAILED DESCRIPTION OF THE INVENTION

The colorant system of the present invention includes water-soluble colorants selected from a group consisting of C.I. Acid Red #52, C.I. Reactive Red #147, C.I. Reactive Red #56, and mixtures thereof.

The preferred colorant is C.I. Reactive Red #56, due to the most pleasing pink color it provides in the liquid fabric conditioning compositions. C.I. Reactive Red #56 demonstrates the best stability upon direct exposure to light. The red colorants employed in the present invention can be obtained from the following suppliers:

| Colorant | Trademark | Supplier |
|---|---|---|
| C. I. Acid Red #52 | Sandolan Rhodamine E-B Powder 400 | Sandoz Chemicals |
| C. I. Reactive Red #147 | Drimarene Brilliant Red R/K-4BL Powder | Sandoz Chemicals |
| C. I. Reactive Red #56 | Drimarene Brilliant Red X-2B Powder | Sandoz Chemicals |

It should be understood that equivalent dyes that are not certified but that correspond chemically to the above certified dyes, are also included in the present invention.

The amount of the colorants is in the range of from about 1 ppm to about 1000 ppm, preferably from about 5 ppm to about 200 ppm, most preferably from about 5 ppm to about 100 ppm.

Red dyes, or mixtures of red dyes, employed in the present invention may provide at some concentrations pink colors that have a slight blue or violet hue. C.I. Acid Yellow #17 has been found effective for overcoming blue or violet tinge to attain a more pleasing pink, or for producing a peach color.

The fabric softening component employed in the present invention includes a cationic fabric softening compound, preferably a quaternary ammonium compound. The counterion may be a halide, such as fluoride, chloride, bromide, or iodide. Other counterions may be employed such as methylsulfate, ethylsulfate, hydroxide, acetate, formate, sulfate, carbonate and the like. Preferably, the counterion is chloride or methylsulfate, chloride being especially preferred for liquid fabric conditioning compositions of the present invention.

Examples of cationic quaternary ammonium salts include, but are not limited to:

(1) Acyclic quaternary ammonium salts having at least two $C_{8-30}$, preferably $C_{12-22}$ alkyl chains, such as: ditallowdimethyl ammonium chloride (Adogen 432(®) from Sherex), di(hydrogenated tallow)dimethyl ammonium chloride (Adogen 442(®) from Sherex), distearyldimethyl ammonium chloride (Arosurf TA-100(®) from Sherex), dicocodimethyl ammonium chloride (Variquat K300(®) from Sherex), and the like;

(2) Cyclic quaternary ammonium salts of the imidazolinium type such as di(hydrogenated tallow)-dimethyl imidazolinium chloride, 1-ethylene-bis(2-tallow-1-methyl) imidazolinium chloride (Varisoft 6112(®) from Sherex) and the like;

(3) Diamido quaternary ammonium salts such as: methyl-bis(hydrogenated tallow amidoethyl)-2-hydroxyethyl ammonium methylsulfate (Varisoft 110(®) from Sherex), methyl bis(tallowamidoethyl)-2-hydroxypropyl ammonium methylsulfate (Varisoft 238(®) from Sherex) and the like;

(4) Biodegradable quaternary ammonium salts such as N,N-di(tallowoyl-oxy-ethyl)-N,N,-dimethyl ammonium chloride and N,N-di(tallowoyl-oxy-propyl)-N,N-dimethyl ammonium chloride. When fabric conditioning compositions employ biodegradable quaternary ammonium salts, pH of the composition is preferably adjusted to between about 2 and about 5. Biodegradable quaternary ammonium salts mentioned above are described more fully in U.S. Pat. Nos. 4,767,547 and 4,788,491 incorporated by reference herein.

Biodegradable cationic diester compounds may be employed which have the formula:

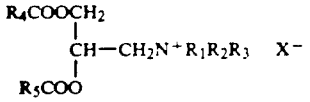

These cationic diesters are described in greater detail in U.S. Pat. No. 4,137,180, which patent is incorporated by reference herein.

(5) Mixtures of water-insoluble cationic fabric softener and a polyalkoxylated ammonium salt as described in U.S. Pat. No. 4,422,949 the disclosure of which is incorporated by reference herein. Such mixtures may be particularly suitable for incorporation in a concentrated form of the liquid compositions herein.

Cationic nitrogenous salts having one long chain acyclic aliphatic $C_{8-30}$ aliphatic group, preferably $C_{12-22}$, may also be employed as the cationic fabric softening compound herein. Examples include but are not limited to:

1) Acyclic quaternary ammonium salts. These include for instance monoalkyltrimethylammonium salts such as monotallowtrimethylammonium chloride, mono(hydrogenated tallow)trimethylammonium chloride, palmityltrimethylammonium chloride and soyatrimethylamonium chloride, sold by Sherex Chemical Company under trademarks Adogen(®) 471, Adogen(®) 441, Adogen(®) 444 and Adogen(®) 415. Also included are behenyltrimethyl ammonium chloride, soyadimethylethylammonium ethylsulfate and methyl-bis(2-hydroxyethyl)octadecylammonium chloride.

2) Substituted imidazolinium salts, such as 1-ethyl-1-(2-hydroxyethyl)-2-isoheptadecylimidazolinium ethylsulfate.

3) Alkylpyridinium salts.

4) Alkanamide alkylene pyridinium salts.

The fabric softening component may include other fabric conditioning compounds in addition to the cationic fabric softening compounds described above. Particularly suitable additional fabric softeners employed herein can be selected from the following classes of compounds:

(i) Tertiary fatty amines having at least one and preferably two $C_8$ to $C_{30}$, preferably $C_{12}$ to $C_{22}$ alkyl chains. Examples include trihydrogenated tallow amine (Adogen 340(®) from Sherex) and cyclic amines such as 1-(hydrogenated tallow)amidoethyl-2-(hydrogenated tallow) imidazoline. Cyclic amines which may be employed for the compositions herein are described in U.S. Pat. No. 4,806,255, incorporated by reference herein.

(ii) Reaction products of stearic acid and aminoethylethanolamine known as stearamidoethyl ethanolamine (Ceranine base 39(®) from Sandoz). When fabric conditioning compositions employ such reaction products, pH of the composition is preferably adjusted to between about 2 and about 5.

(iii) Carboxylic acids having 8 to 30 carbon atoms and one carboxylic group per molecule. The alkyl portion has 8 to 30, preferably 12 to 22 carbon atoms. The alkyl portion may be linear or branched, saturated or unsaturated, with linear saturated alkyl preferred. Stearic acid is a preferred fatty acid for use in the composition herein. Examples of these carboxylic acids are commercial grades of stearic acid and the like which may contain small amounts of other acids.

(iv) Esters of polyhydric alcohols such as sorbitan esters or glycerol stearate. Sorbitan esters are the condensation products of sorbitol or iso-sorbitol with fatty acids such as stearic acid. Preferred sorbitan esters are monoalkyl. A common example of sorbitan ester is SPAN60 (ICI) which is a mixture of sorbitan and isosorbide stearates.

(v) Fatty alcohols, ethoxylated fatty alcohols, alkyl phenols, ethoxylated alkyl phenols, ethoxylated fatty amines, ethoxylated monoglycerides, ethoxylated diglycerides, ethoxylated fatty amides (e.g. tallow mono ethanolamide which is ethoxylated with five moles of EO - Varamide T55(®) from Sherex).

(vi) Mineral oils, and polyols such as polyethylene glycol.

Preferred fabric softeners for use herein are acyclic quaternary ammonium salts, ditallowdimethyl ammonium chloride being most preferred for fabric conditioning compositions of the present invention.

An especially preferred fabric softener combination is a combination of an acyclic quaternary ammonium salt and an ethoxylated fatty amide, particularly as described in U.S. Pat. No. 4,497,716 incorporated by reference herein. In particular the ammonium salt, di(hydrogenatedtallow)dimethyl ammonium chloride (Adogen 442(®) from Sherex) may be combined with the ethoxylated fatty amide, tallow mono ethanolamide (Varamide T-55(®) from Sherex), preferably in a ratio of from about 10:1 to about 1:1, more preferably in a ratio of from about 6:1 to about 1.1. In the most preferred embodiment the ratio of the ammonium salt to the amide is from about 4:1 to about 5:1.

It may be appreciated that various combinations of fabric softening compounds to form the fabric softening component may be used by the skilled artisan without departing from the scope of the present invention.

About 1% to about 40% of the fabric softening component is used in the compositions of the invention. There must be included at least a sufficient amount of the cationic fabric softening compound to achieve antistatic effect, for example at least about 1% to about 3% in the dilute product and at least about 2% to about 5% in the concentrated product. On the other hand, the entire fabric softening component may be a cationic fabric softening compound. The diluted version of the product contains about 1% to about 12%, preferably about 3% to about 10% and most preferably about 4% to about 7% of the fabric softening component, based on % active. The concentrated version of the product contains about 13% to about 40%, preferably about 13% to 30% and most preferably about 13% to about 20% of the fabric softening component, based on % active.

The fabric conditioning compositions of the present invention include a liquid carrier, which is water and which may additionally contain organic solvents such as lower alcohols selected from, for example, methyl alcohol, ethyl alcohol and isopropanol. Other liquid carriers include alkylene glycols, such as ethylene glycol or propylene glycol. Both the diluted and the concentrated versions of the product are preferably dispersions of the active ingredients in the water solvent matrix.

According to the present invention, the pH of liquid fabric conditioning compositions is less than about 7, and is preferably in the range of from 4 to 6.5. Typically, there is no need to adjust pH of the compositions. However, if there is a need to adjust pH of the compositions, any acidic material may be used. Examples of suitable acids include citric, hydrochloric, acetic, sulfuric, phosphoric, maleic acids and the like. The pH is measured by a glass electrode in comparison with a standard calomel reference electrode.

Various additives may be optionally employed in the conditioning compositions of the present invention. These include silicones, such as predominantly linear polydialkylsiloxanes, e.g. polydimethylsiloxanes; soil release polymers such as block copolymers of polyethylene oxide and terephthalate; fatty amines selected from the group consisting of primary fatty amines, secondary fatty amines, tertiary fatty amines and mixtures thereof; amphoteric surfactants; smectite type inorganic clays; anionic soaps; zwitterionic quaternary ammonium compounds and nonionic surfactants.

Other optional ingredients include emulsifiers, electrolytes (for example, sodium chloride or calcium chloride) preferably in the range from 5 to 500 ppm, optical brighteners or fluorescent agents preferably in the range from 0.01 to 5%, buffers, perfumes preferably from 0.1 to 5%, germicides, bactericides, and bacteriostatic agents. Bacteriostatic agents are preferably employed in the range from 1 to 1000 ppm.

It has been found particularly desirable to include in the inventive compositions deodorant perfumes disclosed in U.S. Pat. No. 4,134,838 incorporated by reference herein. According to the present invention, the compositions preferably include from 0.01 to 10%, preferably 0.1% to 1% by weight of a deodorant perfume described in the '838 patent.

The fabric conditioning compositions of the present invention also may optionally contain an agent which produces a pearlescent appearance. Preferred pearlizing agents include an organic pearlizing compound such as ethylene glycol distearate, or inorganic pearlizing pigments such as microfine mica. Titanium dioxide ($TiO_2$) coated mica is an especially preferred pearlizing agent. Other pearlizing agents known in the art may be used in the present invention by the skilled artisan, such as for example those described in U.S. Pat. No. 4,654,163 issued to Quack et al., herein incorporated by reference.

The organic pearlizing agent, ethylene glycol distearate, may be added to the composition in the amount and manner described in pending U.S. application Ser. No. 07/486,038 filed on Feb. 27, 1990, herein incorporated by reference. Specifically, a preferred fabric conditioning composition comprises:

(i) an aqueous base
(ii) a cationic fabric softener material;
(iii) a fatty acid material; and
(iv) ethylene glycol distearate.

Aqueous fabric conditioning compositions generally comprise a dispersed phase of the active materials, such a phase can for instance be prepared by co-melting the active materials followed by mixing the co-melt under stirring into water. Compositions according to the present invention may contain the ethylene glycol distearate component as part of the cationic dispersed phase. Surprisingly, however, it has been found that the pearlescent appearance is even more pronounced, when the ethylene glycol distearate is present as a separate dispersed phase in the composition.

In the preparation of a fabric softening composition, the formation of a separate dispersed phase for the ethylene glycol distearate may for instance be effected by adding the ethylene glycol distearate in the form of a separate predispersion, after the forming of the first dispersed phase of other active materials.

The ethyleneglycol distearate ingredient of compositions according to the present invention can be added as such; in that case the compositions according to the invention are preferably heated above the melting temperature of the ethyleneglycol distearate to allow the formation of ethyleneglycol distearate crystals upon cooling. These crystals are believed especially to be advantageous as far as the appearance of the product is concerned.

Especially preferred is the addition of the ethyleneglycol distearate component in the form of a predispersion. This generally avoids the need of heating the product above the melting temperature of the ethylene glycol distearate while still providing the appearance advantages.

The predispersion of ethylene glycol distearate is preferably of cationic or nonionic nature. Examples of cationic/nonionic predispersions are for instance disclosed in U.S. Pat. Nos. 4,654,163 and 4,777,038, which are incorporated by reference herein.

The amount of ethylene glycol distearate in compositions according to the present invention is preferably such that the weight ratio of cationic fabric softening material to ethyleneglycol distearate is between about 100:1 and 1:1, more preferably between about 25:1 and 2:1, especially preferred between about 20:1 and 5:1.

The level of ethylene glycol distearate is preferably above 0.1% by weight, more preferred above 0.2% by weight, especially preferred above 0.3% by weight of the composition. For reasons of costs and stability the level of ethylene glycol distearate is preferably not above 10%, more preferred not more than 5%, most preferred not more than 2.5% by weight of the composition.

Typical products according to the present invention may for instance comprise from 0.2 to 2%, more preferred from 0.3 to 1.5% by weight of ethylene glycol distearate.

Compositions according to the present invention preferably also comprise a fatty acid component. Especially suitable combinations of fatty acid and cationic softening materials are disclosed in U.S. Pat. No. 4,308,024, incorporated by reference herein. Typical blends of cationic materials and fatty acids suitable for being used in conjunction with ethylene glycol distearate in compositions according to the present invention include 20–95 mole % of a cationic softening material and 5–80 mole % of a fatty acid material.

Preferably, the pearlizing agent used in the present invention is mica and more preferably mica which has been coated with titanium dioxide ($TiO_2$). The $TiO_2$ coated mica should have a particle size in the range of about 1 to about 15 microns for stability. Such a coated mica product may be obtained from EM Industries, Inc.

of Hawthorne, N.Y. under the trademark Afflair(®) 110 or Afflair(®) 111, preferably Afflair(®) 111.

The $TiO_2$ mica is preferably added to the fabric softener composition in a range of about 0.01% to about 1.0% by weight, and preferably in a range of about 0.05% to about 0.4%, and most preferably about 0.10% to about 0.20% by weight. The liquid fabric conditioning compositions can be prepared by conventional methods. A convenient and satisfactory method is to prepare the softening active premix at about 50°-80° C., which is then added with stirring to the hot water. Temperature-sensitive components can be added after the fabric softening composition is cooled to a lower temperature. The colorant may be added to the composition at any point. Preferably, the colorant is added to the hot water prior to the mixing with the active premix.

The fabric conditioning compositions of the invention can be used in the rinse cycle of a conventional home laundry operation. Generally, rinse water has a temperature of from about 5° C. to about 60° C. The concentration of the total active ingredients is generally from about 2 ppm to about 1000 ppm, preferably from about 10 ppm to about 500 ppm, by weight of the aqueous rinsing bath. When multiple rinses are used, the fabric conditioning compositions are preferably added to the final rinse.

Typically, the amount of staining possibly imparted to the fabric by any fabric softener depends on the type of fabric, the concentration of the dye in the composition, and whether there is a direct contact of the fabric conditioner with the fabric. Preferably, to minimize the possibility of staining, the fabric softener of the present invention is added after a laundry machine is filled or at least partially filled with water, in order to avoid direct contact of the fabric softener with fabrics in the wash. Alternatively, the fabric softener composition may be diluted with at least about an equal amount of water, and the resulting mixture may be introduced in a washing machine before or during the rinse cycle.

The following Examples will more fully illustrate the embodiments of this invention. All parts, percentages and proportions referred to herein and in the appended claims are by weight of the composition unless otherwise indicated.

EXAMPLE 1

| Ingredient | % by Weight (100% active basis) in the final composition | | | | | |
|---|---|---|---|---|---|---|
| | A | B | C | D | E | F |
| Adogen ® 442 | 6.25 | 6.25 | 6.25 | 6.25 | 6.25 | 6.25 |
| Ucarcide ® Antimicrobial 250[1] | 0.07 | 0.07 | 0.07 | 0.07 | 0.07 | 0.07 |
| Perfume | 0.35 | 0.35 | 0.35 | 0.30 | 0.3 | 0.35 |
| Calcium Chloride | 0.0153 | 0.0176 | 0.01 | 0.003 | 0.0157 | 0.018 |
| C. I. Reactive Red #147 | 0.0007 | — | — | — | — | — |
| C. I. Acid Red #52 | — | 0.00015 | — | 0.0002 | — | — |
| C. I. Reactive Red #56 | — | — | 0.0014 | — | — | — |
| C. I. Acid Yellow #17[2] | — | — | — | 0.0002 | — | 0.0001 |
| C. I. Acid Red #131[3] | — | — | — | — | 0.00018 | — |
| Basic Violet #16[5] | — | — | — | — | 0.00012 | — |
| D&C Red #28[4] | — | — | — | — | — | 0.0004 |
| Water | BALANCE | | | | | |
| pH | 4.28 | 4.3 | 4.4 | 4.55 | 4.57 | 3.31 |

[1]Obtained from Union Carbide Corp.
[2]Erio Yellow ZG ®, obtained from Ciba-Geigy, or Sandolan Yellow-ZGL ®, obtained from Sandoz, or Hidaacid Fast Yellow ZG ®, obtained from Hilton Davis
[3]Brilliant Red N3B ®, obtained from Sandoz
[4]Pholoxine B, obtained from Hilton Davis.
[5]Sandocyl Red B-6B ®, obtained from Sandoz The above compositions A through F were prepared as follows: Adogen 442(®) was heated to 140° F. The aqueous phase was prepared by mixing and heating to about 140° F. Ucarcide(®) antimicrobial, calcium chloride, and the colorant in water. Subsequently, Adogen 442(®) was added with stirring to the aqueous phase.

Compositions A, B, C and D, which are within the scope of the invention, provided consumer desirable nice pink colors of different shades. Compositions A, B, C and D were also substantially non-fading at room temperature in a clear jar for at least one year. Compositions A, B, C, D, packaged in an opaque bottle were also substantially non-fading for at least two months when exposed to sunlight. When placed in transparent bottles, compositions A, B, C, and D were substantially non-fading for at least one week in direct sunlight, and were substantially non-fading in the absence of daylight for at least one month under extreme temperature conditions (125° F.). Composition F, which is not within the scope of the present invention, provided a pink shade, but when placed in a transparent bottle, composition F faded substantially in three days in direct sunlight. Composition E, which is not within the scope of the invention, faded substantially under extreme temperature conditions (125° F.) in two weeks, when placed in a transparent jar.

EXAMPLE 2

| Ingredient | Wt % (100% active basis) |
|---|---|
| 1-trimethyl ammonium 2,3-di($C_{14}$–$C_{18}$ acyloxy) propane chloride | 6.25 |
| Ucarcide Antimicrobial 250 ® | 0.07 |
| C. I. Reactive Red #56 | 0.0014 |
| Calcium Chloride | 0.02 |
| Perfume | 0.35 |
| Water | Balance |
| pH | 2.82 |

The composition of Example 2 was prepared as follows: The aqueous phase was prepared by mixing and heating to about 160° F. Ucarcide antimicrobial, calcium chloride and water. The biodegradable cationic diester was heated to about 150° F. with constant stirring of the aqueous phase. The diester was then added to the aqueous phase, after which the perfume was added. The product was cooled to ambient temperature while the stirring was continued constantly. The red dye was added at room temperature.

The composition of Example 2 was of desirable pink shade and was stable in a transparent bottle upon exposure to sunlight for at least 4 days.

EXAMPLE 3

To determine whether direct contact of a liquid fabric conditioning product causes staining by colorant on the fabric, the Direct Staining Test was conducted as follows:

APPARATUS, MATERIALS 250 ml beaker
Glass stirring rod
5.75"×5.75" swatches of:
- Terry cloth
- 65/35 Dacron/cotton permanent press
- Diaper (100% cotton Birdseye type)
- Lycra
- Silk
- Wool
- 65/35 Dacron/cotton
- Acetate
- Spun Dacron
- Spun Nylon
- Spun Orlon
- Spun Viscose
- Banlon
- Wool flannel
- Texturized polyester twill
- Polyester double knit ½ teaspoon measure
Kenmore(®) washing machine—Model 70 or equivalent
Detergent
Medicine dropper
Procedure:

Fabric swatches were washed in 100° F. water with detergent. At the completion of the wash, the machine was allowed to spin only long enough to remove excess wash solution. The cloths were not spray rinsed or rinsed in any way. All cloths were removed from the washing machine and dried in a static dryer. After drying, 20 drops fabric conditioner were applied directly to the cloths and the cloths were folded with pressure in order to obtain about a 2" circle. The stained cloths were allowed to age about 24 hours, then put through a rinse cycle only in the Kenmore(®) washing machine (no additional softener was added). The cloths were dried again. The cloths were visually evaluated under simulated northern daylight and rated for residual staining according to the following system:

0—no staining
2—trace
4—slight
6—moderate
8—considerable

The scores obtained for each cloth were then added to obtain a total staining score. The test was repeated for every fabric conditioning composition that was tested. The lower the total staining score, the less staining there was.

The test compared the amount of staining produced by Composition A, B and C (prepared in Example 1) to the amount of staining produced by commercial fabric softeners containing colorants.

| | Total Staining Score |
|---|---|
| Commercial Fabric Softener I | 60 |
| Commercial Fabric Softener II | 48 |
| Composition A | 46 |
| Composition B | 48 |
| Composition C | 46 |

It can be seen that Compositions A, B and C which are within the scope of the invention do not stain any worse than commercial colored fabric softeners.

What is claimed is:

1. A fabric conditioning composition comprising
   a) about 1% to about 40% by weight of said composition of a fabric softening component comprising a cationic fabric softening compound;
   b) about 1 ppm to about 1,000 ppm of a colorant system comprising a colorant selected from the group consisting of C.I. Acid Red #52, C.I. C.I. Reactive Red #56, and mixtures thereof; and
   c) a liquid carrier including water, the pH of the composition being less than about 7.

2. The composition of claim 1 wherein the colorant is C.I. Reactive Red #56.

3. The composition of claim 1 wherein the composition comprises about 5 ppm to about 200 ppm of the colorant system.

4. The composition of claim 1 wherein the composition comprises about 5 ppm to about 100 ppm of the colorant system.

5. The composition of claim 1 wherein the composition comprises about 4% to about 35% of the fabric softening component.

6. The composition of claim 1 wherein the composition comprises about 4% to about 30% of the fabric softening component.

7. The composition of claim 1 wherein the fabric softening component is selected from the group consisting of acyclic quaternary ammonium salts having at least two $C_{8-30}$ alkyl chains, quaternary imidazolinium salts, diamido quaternary ammonium salts, biodegradable quaternary ammonium salts and mixtures thereof.

8. The composition of claim 1 wherein the fabric softening component is selected from the group consisting of di(hydrogenatedtallow)dimethyl ammonium chloride and ditallowimidazolinium chloride.

9. The composition of claim 1 wherein the pH of the composition is about 4 to about 6.5.

10. A method for softening fabrics comprising treating the fabrics in an aqueous bath with the fabric conditioning composition of claim 1.

* * * * *